US010465949B2

(12) United States Patent
Liu

(10) Patent No.: US 10,465,949 B2
(45) Date of Patent: Nov. 5, 2019

(54) HVAC SYSTEMS AND METHODS WITH MULTIPLE-PATH EXPANSION DEVICE SUBSYSTEMS

(71) Applicant: Lennox Industries Inc., Richardson, TX (US)

(72) Inventor: Wenqian Liu, Plano, TX (US)

(73) Assignee: Lennox Industries Inc., Richardson, TX (US)

( * ) Notice: Subject to any disclaimer, the term of this patent is extended or adjusted under 35 U.S.C. 154(b) by 134 days.

(21) Appl. No.: 15/642,314

(22) Filed: Jul. 5, 2017

(65) Prior Publication Data

US 2019/0011153 A1 Jan. 10, 2019

(51) Int. Cl.

| | |
|---|---|
| ***F25B 13/00*** | (2006.01) |
| ***F25B 39/00*** | (2006.01) |
| ***F25B 41/00*** | (2006.01) |
| ***F25B 41/04*** | (2006.01) |
| ***F24F 11/30*** | (2018.01) |
| ***F25B 39/04*** | (2006.01) |

(52) U.S. Cl.

CPC ..... *F25B 13/00* (2013.01); *F24F 11/30* (2018.01); *F25B 39/00* (2013.01); *F25B 41/003* (2013.01); *F25B 41/04* (2013.01); *F25B 39/04* (2013.01); *F25B 2341/0661* (2013.01); *F25B 2341/0683* (2013.01); *F25B 2600/2507* (2013.01); *F25B 2600/2513* (2013.01); *F25B 2700/195* (2013.01); *F25B 2700/1931* (2013.01); *F25B 2700/2104* (2013.01)

(58) Field of Classification Search

CPC ..... F25B 13/00; F25B 39/00; F25B 41/003; F25B 2700/195; F25B 39/04; F25B 41/04; F25B 2700/1931; F25B 2600/2513; F25B 2600/2507; F25B 2341/0683; F25B 2341/0661; F25B 2700/2104; F24F 11/30

USPC ..... 62/115

See application file for complete search history.

(56) References Cited

U.S. PATENT DOCUMENTS 2,234,250 A * 3/1941 Harris ..... F25B 5/00 236/1 B
2,252,300 A * 8/1941 McGrath ..... F25B 41/04 62/196.4
2,451,385 A * 10/1948 Groat ..... F25B 41/06 137/513.3
3,264,837 A * 8/1966 Harnish ..... F25B 13/00 62/117

(Continued)

FOREIGN PATENT DOCUMENTS

WO WO-2015051799 A1 * 4/2015 ..... F25B 39/04

*Primary Examiner* — Ljiljana V. Ciric
(74) *Attorney, Agent, or Firm* — Hubbard Johnston, PLLC

(57) ABSTRACT

A heating, ventilation, air conditioning (HVAC) system includes a multi-path expansion device subsystem positioned between a condenser and an evaporator. The multi-path expansion device subsystem includes a flow selector operative to receive a refrigerant from the condenser and selectively deliver the same to a full-load pathway or to a partial-load pathway. The full-load pathway has a modulating valve and a fixed orifice sized for a full-load situation, and the partial-load pathway has a thermal expansion valve (TXV) sized for partial load operation. A controller uses an actuator of the flow selector to choose which pathway is authorized according to certain process logic.

11 Claims, 4 Drawing Sheets

(56) References Cited

U.S. PATENT DOCUMENTS 3,371,500 A * 3/1968 Marcus, Jr. ..... F25B 41/04 62/117
3,386,259 A * 6/1968 Kirkpatrick ..... B60H 1/00007 62/156
3,768,274 A * 10/1973 Fink ..... F25B 41/04 62/159
3,977,205 A * 8/1976 Dreisziger ..... F25B 5/02 62/117
4,136,528 A * 1/1979 Vogel ..... F25B 41/04 62/174
4,193,781 A * 3/1980 Vogel ..... F25B 49/02 236/1 E
4,311,498 A * 1/1982 Miller ..... F25B 29/003 62/181
4,437,317 A * 3/1984 Ibrahim ..... F25B 47/022 62/152
4,645,908 A * 2/1987 Jones ..... F24D 11/0214 392/340
4,685,307 A * 8/1987 Jones ..... F24D 11/0214 62/160
4,685,309 A * 8/1987 Behr ..... F25B 5/00 251/129.05
4,809,516 A * 3/1989 Jones ..... F24D 11/0214 62/160
4,899,552 A * 2/1990 Minari ..... F25B 41/04 62/222
5,056,324 A * 10/1991 Haley ..... F25B 29/003 62/115
5,105,632 A * 4/1992 Naruse ..... F25B 47/022 62/196.4
5,172,557 A * 12/1992 Hubbell, Jr. ..... F25B 41/003 62/292
5,174,123 A * 12/1992 Erickson ..... F25B 1/047 62/113
5,193,353 A * 3/1993 Brendel ..... B60H 1/00014 62/196.4
5,197,298 A * 3/1993 Kobayashi ..... B60H 1/3225 62/115
5,237,833 A * 8/1993 Hayashida ..... F24F 3/065 62/228.1
5,337,574 A * 8/1994 Dick ..... F24F 1/022 62/89
5,379,606 A * 1/1995 Katsuki ..... F24F 3/065 62/126
5,388,419 A * 2/1995 Kaye ..... F25B 13/00 62/160
5,440,890 A * 8/1995 Bahel ..... F25B 13/00 62/81
5,729,992 A * 3/1998 Lambert ..... E21B 10/58 62/149
5,752,391 A * 5/1998 Ozaki ..... B60H 1/3204 62/208
5,907,957 A * 6/1999 Lee ..... F25B 41/04 62/181
6,321,549 B1 * 11/2001 Reason ..... B60H 1/00885 62/223
6,324,856 B1 * 12/2001 Weng ..... F25B 7/00 62/175
6,708,510 B2 * 3/2004 Sulc ..... B60H 1/00907 62/151
6,964,178 B2 * 11/2005 Aikawa ..... F25B 41/00 62/434
9,222,712 B1 * 12/2015 Zugibe ..... F25B 49/02
9,803,902 B2 * 10/2017 Pham ..... F25B 45/00
9,915,436 B1 * 3/2018 Feria ..... F24D 19/1087
2002/0050148 A1 * 5/2002 Shyy ..... F04B 43/043 62/498
2004/0206096 A1 * 10/2004 Jayanth ..... F25B 49/005 62/127
2005/0081551 A1 * 4/2005 Dail ..... A47F 3/0443 62/298
2005/0263352 A1 * 12/2005 Fideler ..... F16H 57/0434 184/6.1
2006/0230770 A1 * 10/2006 Kitsch ..... F25B 13/00 62/151
2006/0238298 A1 * 10/2006 Ritter ..... G06Q 20/341 340/5.64
2007/0000276 A1 * 1/2007 Tso ..... F25B 13/00 62/324.1
2007/0256432 A1 * 11/2007 Zugibe ..... F25B 43/02 62/115
2008/0289354 A1 * 11/2008 Dudley ..... F25B 5/02 62/335
2010/0175396 A1 * 7/2010 Lifson ..... F25B 31/002 62/115
2010/0281894 A1 * 11/2010 Huff ..... F25B 9/008 62/115
2011/0036113 A1 * 2/2011 Kopko ..... F25B 29/003 62/324.5
2011/0079032 A1 * 4/2011 Taras ..... F24F 3/153 62/113
2011/0126559 A1 * 6/2011 Kopko ..... F25B 45/00 62/79
2011/0132007 A1 * 6/2011 Weyna ..... F25B 49/027 62/115
2012/0031130 A1 * 2/2012 Morimoto ..... F16K 27/003 62/196.1
2012/0042674 A1 * 2/2012 Takenaka ..... F24F 3/06 62/180
2013/0167572 A1 * 7/2013 Yamashita ..... F25B 13/00 62/190
2013/0180268 A1 * 7/2013 Schlosser ..... F25C 1/12 62/66
2013/0269370 A1 * 10/2013 Hatakeyama ..... F25B 13/00 62/56
2014/0260368 A1 * 9/2014 Wintemute ..... F25B 6/04 62/89
2015/0354875 A1 * 12/2015 Fuller ..... F25B 13/00 62/498
2016/0047595 A1 * 2/2016 Williams ..... F25D 29/001 62/62
2016/0178249 A1 * 6/2016 Kwon ..... F25B 13/00 62/160
2016/0238298 A1 * 8/2016 Goel ..... F25B 49/02
2017/0030621 A1 * 2/2017 Hung ..... F25B 49/02
2018/0106510 A1 * 4/2018 Brown ..... F25B 25/005
2018/0187931 A1 * 7/2018 Feria ..... F25B 25/005

* cited by examiner

HVAC SYSTEMS AND METHODS WITH MULTIPLE-PATH EXPANSION DEVICE SUBSYSTEMS

TECHNICAL FIELD

The present disclosure relates generally to heating, ventilating, and air conditioning (HVAC) systems, and more particularly, to HVAC systems and methods with multiple-path expansion device subsystems that may be used to control pressure in the system and is well suited for controlling pressure in a micro-channel condenser.

BACKGROUND

Heating, ventilating, and air conditioning (HVAC) systems can be used to regulate the environment within an enclosed space. Typically, an air blower is used to pull air (i.e., return air) from the enclosed space into the HVAC system through ducts and push the air into the enclosed space through additional ducts after conditioning the air (e.g., heating, cooling, or dehumidifying the air).

The cooling aspect of an HVAC system may utilize an evaporator that cools return air from the enclosed space. An expansion valve meters refrigerant to the evaporator while receiving the refrigerant from a condenser. The expansion valve, the evaporator, and the condenser form part of a closed-conduit refrigeration circuit of the HVAC system. There are, at times, issues with refrigerant flow that could benefit from improvements.

DESCRIPTION OF THE DRAWINGS

Illustrative embodiments of the present invention are described in detail below with reference to the attached drawing figures, which are incorporated by reference herein and wherein.

DETAILED DESCRIPTION

Figure 1:
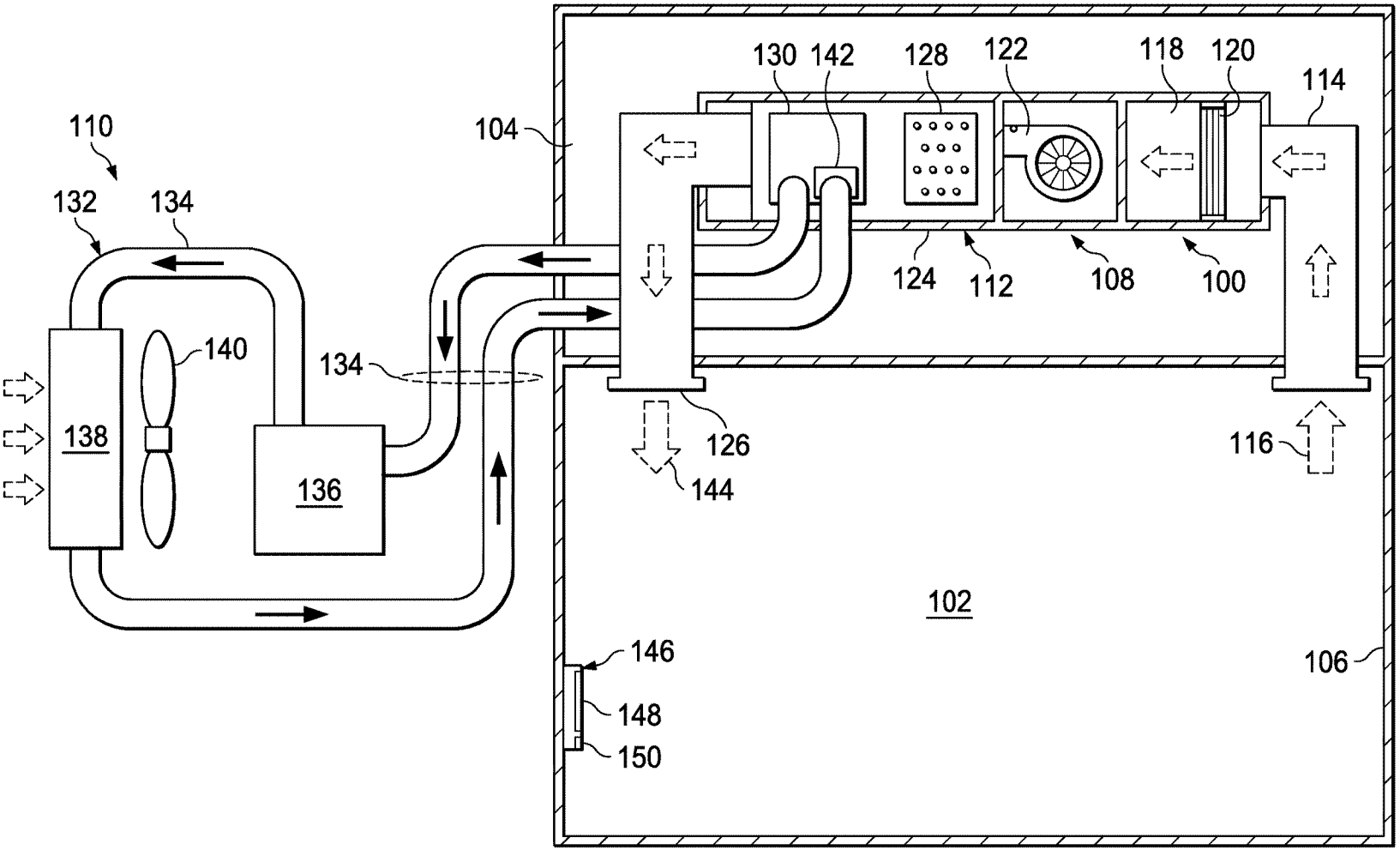
FIG. 1 is a schematic diagram of a heating, ventilating, and air conditioning (HVAC) system for providing conditioned air to a closed spaced, according to an illustrative embodiment.

Heating, ventilating, and air-conditioning (HVAC) systems commonly incorporate an expansion valve or device to regulate refrigerant flowing from a condenser to an evaporator. The expansion valve, the condenser, and the evaporator are components of a closed-conduit refrigerant circuit, which also includes a compressor. During system operation, if sufficient refrigerant is not allowed to drain from a micro-channel condenser, pressure therein may increase beyond a pressure safety threshold, risking unreliable operation of the HVAC system or outright failure (e.g., rupture of the condenser).

Certain operation conditions may also make the pressure in the micro-channel condenser spike. Indeed, micro-channel condensers are charge sensitive and various factors can make a high-pressure trip activate thereby shutting down the system. The system shutdown may be for a period of time or may call for service. Pressure spikes may be caused by numerous factors or conditions, such as field overcharge, high-temperature ambient conditions, condenser fan motor degradation, dirty outside condenser coil, and all of these can cause a high-pressure in the HVAC system. In one non-limiting example, the pressure spike that causes a trip is at about 600 PSI, but other pressures could be used. The high-pressure trips can short cycle the system in a way that eventually shuts down the system resulting in a wait time or a service call. Sometimes the condenser fan speed can be modified to compensate for the condition but this causes loss of efficiency. According to aspects of the disclosure, the high-pressure issue may be avoided as explained further below.

The embodiments described herein relate to systems, devices, and methods for regulating a flow of refrigerant in a heating, ventilating, and air conditioning (HVAC) system using multipath expansion device subsystems. More specifically, systems, devices, and methods are presented that include a multi-path expansion device subsystem having at least a full-load and partial-load pathway. The HVAC system that includes the same have at least one pressure transducer coupled to the high-pressure side conduit for measuring a pressure therein and the pressure information is delivered to a controller. The controller then controls the expansion device subsystem to avoid pressure spikes and trips.

The expansion device subsystem includes a flow selector, e.g., three-way valve or reversing valve or other valve, operative to receive a refrigerant from the high-pressure side conduit and selectively deliver the same to a full-load pathway or to a partial-load pathway. An actuator coupled to the flow selector selectively moves the flow selector between the full-load pathway and the partial-load pathway. The actuator is communicatively coupled to the controller for receiving a control signal therefrom. The full-load pathway may include a modulating valve and includes an orifice for stepping down pressure. The orifice is sized and configured for a full load condition. The partial load pathway includes a variable expansion device (e.g., thermal expansion valve (TXV)) sized and configured for partial load without concerns for the full-load condition.

The controller includes memory and a processor and is configured to: activate the actuator to move the flow selector to the full-load pathway when pressure as measured by the at least one pressure transducer indicates pressure is greater than a first preselected activation pressure or when system operating demand is at full load. The controller is also configured to activate the actuator to move the flow selector to the partial-load pathway when pressure as measured by the at least one pressure transducer indicates pressure is less than a second preselected activation pressure and when the system demand is at partial load. Other systems, tools and methods are presented herein.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

As used herein, the phrases "fluidly coupled," "fluidly connected," and "in fluid communication" refer to a form of coupling, connection, or communication related to fluids, and the corresponding flows or pressures associated with these fluids. In some embodiments, a fluid coupling, connection, or communication between two components may also describe components that are associated in such a way that a fluid can flow between or among the components. Such fluid coupling, connection, or communication between two components may also describe components that are associated in such a way that fluid pressure is transmitted between or among the components.

As used herein, the terms "hot," "warm," "cool," and "cold" refer to thermal states, on a relative basis, of refrigerant within a closed-conduit refrigeration circuit. Temperatures associated with these thermal states decrease sequentially from "hot" to "warm" to "cool" to "cold". Actual temperatures, however, that correspond to these thermal states depend on a design of the closed-conduit refrigeration circuit and may vary during operation.

Referring now to the drawings and initially and primarily to FIG. 1, a heating, ventilating, and air conditioning (HVAC) system 100 is presented. The HVAC system 100 is for providing conditioned air to a first closed space 102, such as an interior of a building. At least a portion of the HVAC system 100 may be disposed within a second closed space 104, or equipment space, or could be open on a rooftop or adjacent a building. The spaces 102, 104 may be defined by a plurality of walls 106. In this embodiment, a portion 108 of the system 100 is located within the building, i.e., within the second closed space 104, and a portion 110 outside the building.

The HVAC system 100 includes an HVAC unit 112 that is disposed within the second closed space 104, or equipment space. In other embodiments, the HVAC unit 112 is substantially located on a rooftop or other location. The HVAC unit 112 includes a return air duct 114 that receives a return air 116 from the first closed space 102. The return air duct 114 may include or be coupled to a transition duct 118 that may include one or more filters 120. A blower 122 pulls the return air 116 into the return air duct 114. The blower 122 is fluidly coupled to the return air duct 114 and moves the return air 116 through the one or more filters, if present, and into a conditioning compartment 124.

The conditioning compartment 124 is fluidly coupled to the blower 122 for receiving air therefrom to be treated, i.e., the return air 118. The conditioning compartment 124 is formed with a plurality of compartment walls and may include a portion of a delivery duct 126 in some embodiments. A heating unit 128 is fluidly coupled to the conditioning compartment 124 for selectively heating air therein. A cooling unit 130 is also fluidly coupled to the conditioning compartment 124 for selectively cooling air therein. The cooling unit 130 includes a refrigerant, or working fluid. The cooling unit 130 may be an evaporator or device for receiving heat from the air flowing over the cooling unit 130. The cooling unit 130 includes at least one heat exchange surface (not explicitly shown). It will be appreciated that the order of the heating unit 128 and cooling unit 130 may be varied.

The cooling unit 130 is associated with a cooling subsystem 132. The cooling subsystem 132 is any system that is operational to develop a chilled working fluid for receiving heat within the cooling unit 130. The cooling subsystem 132 typically includes a closed-conduit circuit 134, or pathway. The refrigerant is disposed within the closed conduit circuit 134. The cooling subsystem 132 also includes a compressor 136 fluidly coupled to the closed-conduit circuit 134 for compressing the refrigerant therein. A condenser 138 is fluidly coupled to the closed-conduit circuit 134 downstream of the compressor 136, which is micro-channel condenser, for cooling the refrigerant. In other embodiments, a different type of compressor could be used, but the system contemplate addressing pressure spikes and high pressure situation that are more commonly issues for a micro-channel condenser. The micro-channel condenser includes a plurality of channels as is known in the art. The micro-channel condenser 138 may be associated with one or more fans 140. A multipath expansion device subsystem 142 (see 202 in FIGS. 2 and 300 in FIG. 3) is fluidly-coupled to the closed-conduit circuit 134 downstream of the condenser 138 for decreasing a pressure of the refrigerant at the cooling unit 130 as will be described in detailed herein. The cooling unit 130 is fluidly coupled to the closed-conduit pathway or circuit 134 for receiving the refrigerant.

Whether heated by the heating unit 128 or cooled by the cooling unit 130, the conditioning compartment 124 produces a treated air 144, or supply air, that is delivered into the first closed space 102 by the delivery duct 126. The delivery duct 126 is fluidly coupled to the conditioning compartment 124 for discharging the treated air 132 from the conditioning compartment 124 into the first closed space 102.

A controller or control unit 146 may be disposed within the first closed space 102 (or elsewhere) and optionally include an input device and a display, such as a touch-screen display 148 and a speaker 150 for audible alerts or instructions. The control unit 146 is communicatively coupled (i.e., in communication through wires, wireless, or other means) with the blower 122, the heating unit 128, the cooling unit 130 (or cooling subsystem), or other devices to be monitored or controlled. The control unit 146 or another controller is used to control the multipath expansion device subsystem 142 as will be described further below. The control unit 146 or another controller is configured to provide control signals to the blower 122, heating unit 128, or cooling unit 130 (or cooling subsystem) in response to at least a measured temperature in the first closed space 102.

Figure 2:
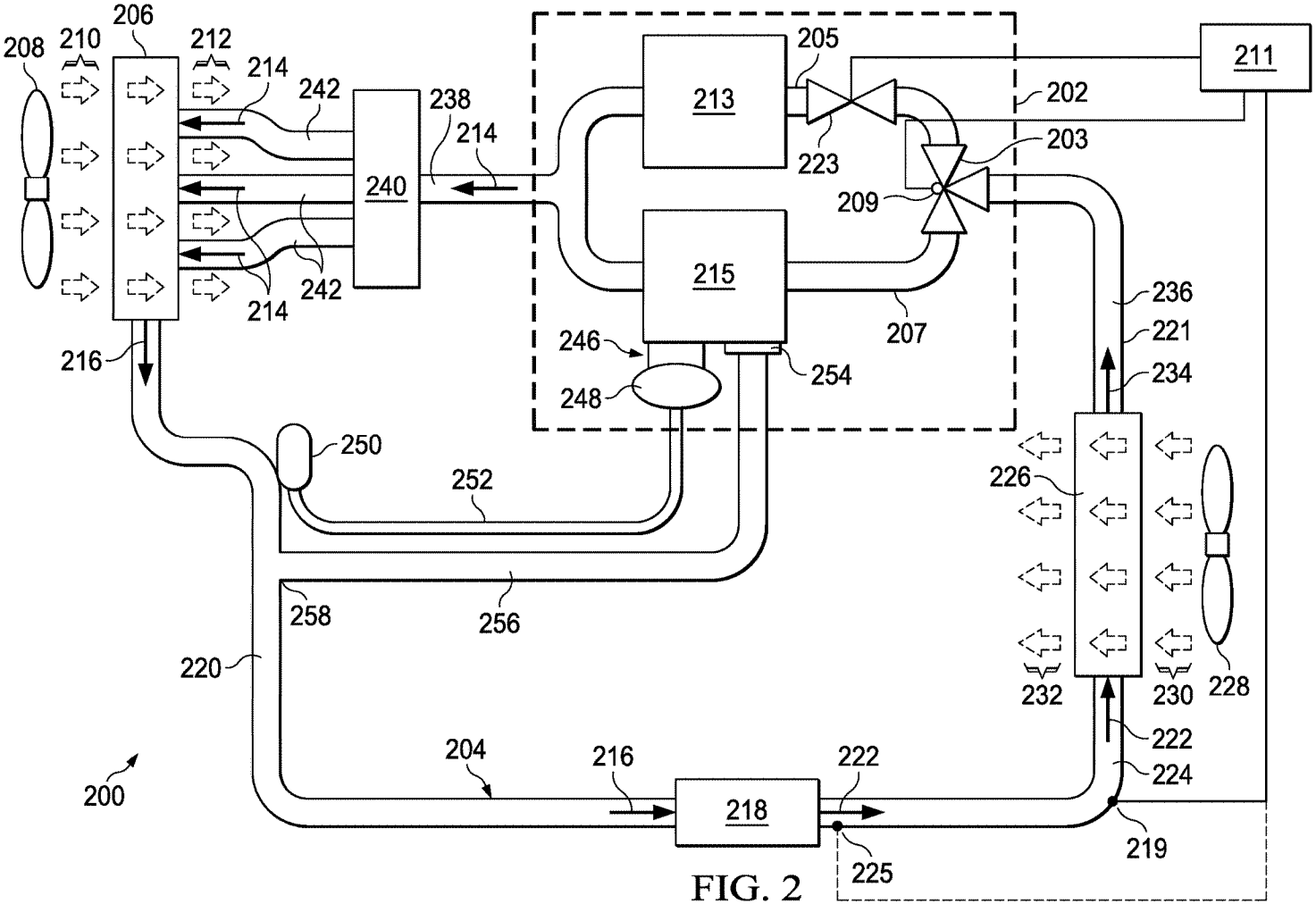
FIG. 2 is schematic diagram of an HVAC system having a multipath expansion device subsystem for regulating a flow of refrigerant within the HVAC system, according to an illustrative embodiment.

Now referring primarily to FIG. 2, a schematic diagram is presented of a heating, ventilating, and air conditioning (HVAC) system 200 having a multipath expansion device subsystem 202 for regulating a flow of refrigerant within the HVAC system 200, according to an illustrative embodiment. The HVAC system 200 includes a closed-conduit refrigeration circuit 204. The closed-conduit refrigeration circuit 204 is shown in FIG. 2 by solid lines that represent fluid coupling between components of the closed-conduit refrigeration circuit 204, such as the multipath expansion device subsystem 202. The solid lines correspond to individual conduits of refrigerant and arrows 214, 216, 222, 232, 234 along the solid lines in FIG. 2 indicate the flow of refrigerant, if present in the HVAC system 200.

The closed-conduit refrigeration circuit 204 includes an evaporator 206 for enabling a cooling capacity of the HVAC system 200. The evaporator 206 typically includes at least one evaporator fan 208 to circulate a return air 210 across one or more heat-exchange surfaces of the evaporator 206. The evaporator 206 is configured to transfer heat from the return air 210 to refrigerant therein. The return air 210 is drawn in from a conditioned space, which may be analogous to the first closed space 102 of FIG. 1, and exits the evaporator 206 as a cooled airflow 212. Concomitantly, a low-pressure two-phase refrigerant 214 enters the evaporator 206 and leaves as a low-pressure gas refrigerant 216.

The closed-conduit refrigeration circuit 204 also includes a compressor 218 fluidly coupled to the evaporator 206 via a suction line 220. The suction line 220 is operable to convey the low-pressure gas refrigerant 216 from the evaporator 206 to the compressor 218. During operation, the compressor 218 performs work on the low-pressure gas refrigerant 216, thereby generating a high-pressure gas refrigerant 222. The high-pressure gas refrigerant 222 exits the compressor 218 through a discharge line 224. In some embodiments, the compressor 218 includes a plurality of compressors that form a tandem configuration within the closed-conduit refrigeration circuit 204. In such embodiments, the plurality of compressors may be fluidly coupled to the suction line 220 through a common suction manifold and fluidly coupled to the discharge line 224 through a common discharge manifold. Other types of fluid couplings are possible.

The closed-conduit refrigeration circuit 204 also includes a micro-channel condenser 226, or other charge-sensitive condenser, that is fluidly coupled to the compressor 218 via the discharge line 224. The condenser 226 typically includes at least one condenser fan 228 to circulate a non-conditioned air 230 across one or more heat exchange surfaces of the condenser 226. The condenser 226 is configured to transfer heat from refrigerant therein to the non-conditioned air 230. The non-conditioned air 230 exits the condenser 226 as a warmed airflow 232. Concomitantly, the high-pressure gas refrigerant 222 enters the micro-channel condenser 226 and leaves as a high-pressure liquid refrigerant 234. The micro-channel condenser 226 typically uses an array of flat aluminum tubes with a plurality of micro-channels, fins between the tubes and two refrigerant manifolds at each end of the tubes. The design helps reduce refrigerant charge for similar coil efficiency.

The closed conduit refrigeration circuit 204 includes a liquid line 236 and a refrigerant line 238. The liquid line 236 fluidly-couples the micro-channel condenser 226 to the multipath expansion device subsystem 202 and is operable to convey the high-pressure liquid refrigerant 234 from the micro-channel condenser 226 to the multipath expansion device subsystem 202. The refrigerant line 238 fluidly-couples the multipath expansion device subsystem 202 to the evaporator 206 and is operable to convey the low-pressure two-phase refrigerant 214 from the multipath expansion device subsystem 202 to the evaporator 206. In some embodiments, a distributor 240 splits the refrigerant line 238 into a plurality of branches 242. These branches 242 transition into a plurality of short heat-transfer circuits (not explicitly shown) upon entry into the evaporator 206. In such embodiments, the plurality of short heat transfer circuits may prevent large drops in pressure that might otherwise occur if a single, long circuit were used.

The multipath expansion device subsystem 202 serves to regulate the flow of refrigerant through the HVAC system 200 and to control a conversion of high-pressure liquid refrigerant 234 into low-pressure two-phase refrigerant 214. Moreover, the multipath expansion device subsystem 202 favorably avoids high-pressure spikes that would otherwise occur and may favorably processes start-up of the closed-conduit refrigeration circuit 204 when the pressure level is relatively high.

The multipath expansion device subsystem 202 includes a flow selector 203 operative to receive a refrigerant from the high-pressure side conduit and selectively deliver the same to a full-load pathway 205 or to a partial-load pathway 207, an actuator 209 coupled to the flow selector 203 for selectively moving the flow selector 203 between the full-load pathway 205 and the partial-load pathway 207. The actuator 209 is communicatively coupled to a controller 211 for receiving a control signal therefrom that causes the actuator 209 to move between the full-load pathway 205 and partial-load pathway 207. The full-load pathway 205 includes a fixed orifice 213 for stepping down pressure and is typically downstream from a modulation valve 223. The orifice 213 is sized and configured for a full load condition. The full-load pathway 205 is fluidly coupled to the refrigerant line 238.

The partial load pathway 207 includes a variable expansion device 215 sized and configured for partial load. Because the variable expansion device 215 does not have to cover the maximum/full load condition the variable expansion device 215 may be sized for more efficiency during partial load. The partial-load pathway 207 is fluidly coupled to the refrigerant line 238. The expansion valve or device 215 includes an actuator 246 coupled to a pin and configured to move the pin in response to a refrigerant temperature. In other embodiments, the actuator 246 includes a chamber 248 having a diaphragm coupled to the pin as is known in the art. A pressure equalizer port 254 fluidly coupled to the suction line 220 of the closed-conduit refrigeration circuit 204 allows a pressure input into the expansion valve or device 215. In such embodiments, the pressure equalization port 254 enables the expansion valve 202 to sense a refrigerant pressure of the low-pressure gas refrigerant 216 exiting the evaporator 206.

The variable expansion device 215 may include a sensor bulb 250 thermally coupled to the suction line 220. Note that in the figure, the sensory bulb 250 is shown only partially touching the suction line 220, but typically the sensory bulb 250 would be fully in contact along its length with the suction line 220. The sensory bulb 250 gives thermal feedback to a variable expansion valve or TXV 215 to control based on temperature in the conduit downstream of the evaporator 206. This should allow for superheat control, but at times it does not.

The controller 211 includes memory and a processor. In some embodiments, the controller 211 may monitor the temperature of a space using a temperature sensor measuring at least the conditioned space 102 (FIG. 1) or the supply air 144 (FIG. 1). Based on the measured temperature and temperature set point, the controller 211 may then determine the system operating demand. If the system operating demand is high, the controller 211 goes to a full load operation for the system 200. If the system operating demand is low, the controller puts the system into a partial load operation. The controller 211 is configured to: activate the actuator 209 to move the flow selector 203 to the full-load pathway 205 when pressure as measured by the at least one pressure transducer (e.g., the pressure transducer 219 on the discharge line 224, which may be located close to the outlet of the compressor 218) indicates pressure is greater than a first preselected activation pressure or when system demand is at full load, and to activate the actuator 209 to move the flow selector 203 to the partial-load pathway 207 when pressure as measured by the at least one pressure transducer 219 indicates pressure is less than a second preselected activation pressure and the system operating demand is less than full load, i.e., partial load. More on this is presented further below.

The HVAC system 200 includes a refrigerant disposed therein. The closed-conduit refrigeration circuit 204 serves to convey refrigerant between components of the HVAC system 200 (e.g., the expansion valve 202, the evaporator 206, the compressor 218, the condenser 226, etc.). Individual components of the closed-conduit refrigeration circuit 204 then manipulate the refrigerant to generate the cooled airflow 212.

The HVAC system 200 has a partial-load operation. To accommodate partial and full load scenarios differently, the expansion device subsystem 202 has one or more devoted pathways, e.g., partial-load pathway 207, that causes the refrigerant to flow to the TXV valve 215 that is sized for the partial load that most of the time the system 200 would be running at.

In operation, the evaporator 206 receives the low-pressure two-phase refrigerant 214 as a cold fluid from the multipath expansion device subsystem 202 via the refrigerant line 238 and, if present, the distributor 240 and associated plurality of branches 242. The cold, low-pressure li two-phase refrigerant 214 flows through the evaporator 206 and, while therein, absorbs heat from the return air 210. Such heat absorption is aided by the at least one evaporator fan 208 and the one or more heat-exchange surfaces of the evaporator 206. The at least one evaporator fan 208 enables a forced convection of return air 210 across the one or more heat-exchange surfaces of the evaporator 206. Absorption of heat by the cold, low-pressure two-phase refrigerant 214 induces a conversion from liquid to gas (i.e., boiling) within the evaporator 206. The cold, low-pressure two-phase refrigerant 214 therefore leaves the evaporator 206 as a warm, low-pressure gas refrigerant 216. Concomitantly, the return air 210 exits the evaporator 206 as the cooled airflow 212.

Conversion of the cold, low-pressure two-phase refrigerant 214 into the warm, low-pressure gas refrigerant 216 often produces a superheated refrigerant whose temperature exceeds a saturated boiling point. Superheated refrigerant is generated when warm, low-pressure gas refrigerant 216 continues to absorb heat after changing from liquid to gas. Such absorption occurs predominantly within the evaporator 206, but may also occur within the suction line 220. A degree of superheat is typically measured in terms of temperature (e.g., ° F., ° C., K) and refers to a difference in temperature between the superheated refrigerant and its saturated boiling point.

After leaving the evaporator 206, the warm, low-pressure gas refrigerant 216 traverses the suction line 220 of the closed-circuit refrigeration circuit 204 and enters the compressor 218. The compressor 218 performs work on the warm, low-pressure gas refrigerant 216, producing a hot, high-pressure gas refrigerant 222. The hot, high-pressure gas refrigerant 222 exits the compressor 218 via the discharge line 224 and travels to the condenser 226. The hot, high-pressure gas refrigerant 222 flows through the micro-channel condenser 226, and while therein, transfers heat to the non-conditioned air 230. Such heat transfer may be assisted by the at least one condenser fan 228 and the one or more heat-exchange surfaces of the condenser 226. The at least one condenser fan 228 enables a forced convection of non-conditioned air 230 across the one or more heat-exchange surfaces of the condenser 226. Loss of heat from the hot, high-pressure gas refrigerant 222 induces a conversion from gas to liquid (i.e., condensing) within the condenser 226. The hot, high-pressure gas refrigerant 222 therefore leaves the micro-channel condenser 226 as a warm, high-pressure liquid refrigerant 234. Concomitantly, the non-conditioned air 230 exits the micro-channel condenser 226 as the warmed airflow 232.

Conversion of the hot, high-pressure gas refrigerant 222 into the warm, high-pressure liquid refrigerant 234 often produce a sub-cooled refrigerant whose temperature is below a saturated condensation point. Sub-cooled refrigerant is generated when warm, high-pressure liquid refrigerant 234 continues to lose heat after changing from gas to liquid. Such loss occurs predominantly within the condenser 226, but may also occur within the liquid line 236. A degree of subcooling is typically measured in terms of temperature (e.g., ° F., ° C., K) and refers to a difference in temperature between the subcooled refrigerant and its saturated condensing point.

After leaving the micro-channel condenser 226, the warm, high-pressure liquid refrigerant 234 flows through the liquid line 236 to reach the multipath expansion device subsystem 202. It will be appreciated that the closed-conduit refrigeration circuit 204 circulates the refrigerant to allow repeated processing by the evaporator 206, the compressor 218, the condenser 226, and the multipath expansion device subsystem 202. Repeated processing, or cycles, enables the HVAC system 200 to continuously produce the cooled airflow 212 during operation. During such cycling, the multipath expansion device subsystem 202 regulates the flow of refrigerant through the HVAC system 200, which includes receiving the warm, high-pressure liquid refrigerant 234 from the micro-channel condenser 226 and metering the cold, low-pressure two-phase refrigerant 214 to the evaporator 206. The former flow influences the degree of subcooling and the latter flow influences the degree of superheat. Higher degrees of superheat reduce a risk that the warm, low-pressure gas refrigerant 216 will enter the compressor 218 with a non-zero liquid fraction. Higher degrees of subcooling reduce a risk that the warm, high-pressure liquid refrigerant 234 will enter the multipath expansion device subsystem 202 with a non-zero gas fraction.

Figure 3:
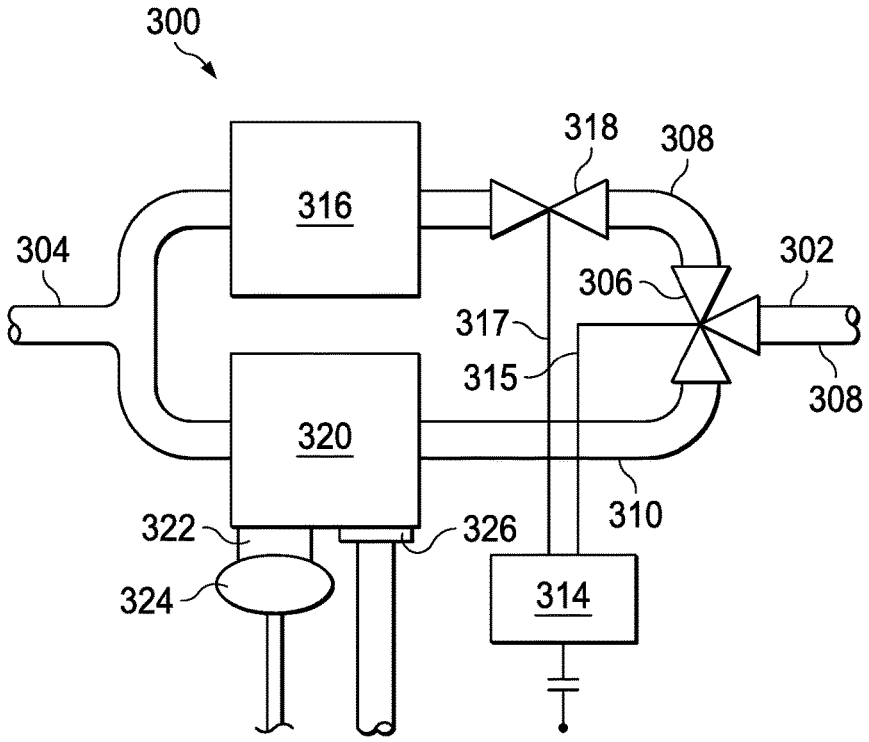
FIG. 3 is schematic diagram of an illustrative embodiment of a multipath expansion device subsystem.

Referring now primarily to FIG. 3, an illustrative, non-limiting embodiment of a multipath expansion device subsystem 300 is presented. The multipath expansion device subsystem 300 receives a high-pressure, warm liquid refrigerant through a liquid line 302 and delivers a low-pressure, cold two-phase refrigerant through a refrigerant line 304. The high-pressure, warm liquid refrigerant is delivered by the liquid line 302 to a flow selector 306. The flow selector 306 is operative to receive a refrigerant from the high-pressure side conduit 308 and selectively deliver the same to a full-load pathway 308 or to a partial-load pathway 310. In other embodiments, additional partial-load pathways could be included.

An actuator 312 is coupled to the flow selector 306 for selectively moving the flow selector between the full-load pathway 308 and the partial-load pathway 310 in response to a control signal from a controller 314. The actuator 312 is communicatively coupled to the controller 314, e.g., wirelessly or by wire 315, for receiving the control signal therefrom. A modulating valve 318 is also communicatively coupled to the controller 314, such as by wire 317 or wirelessly. The controller 314 includes memory and a processor configured to carry out the process steps described herein, see, e.g., FIG. 5. The actuator 312 is coupled to the controller 314. The controller 314 is communicatively coupled to at least one pressure transducer (see e.g., 219 in FIG. 2) on a discharge line such as near the compressor outlet. In one embodiment, pressure transducer 219 may be located at or immediately adjacent the compressor 218 on the discharge line 224 as shown by reference 225. Again, other locations are possible.

The full-load pathway 308 includes a fixed orifice 316 for stepping down pressure. The orifice 316 is sized and configured for a full load condition. The orifice 316 is an expansion device with a fixed orifice. With the orifice 316, the pressure can be managed due to less liquid refrigerant accumulation at the micro-channel condenser 226 at high pressure conditions. Because it is reserved for full load, the orifice 316, or fixed orifice, is sized by the overall HVAC system capacity requirement and refrigerant type at design point.

The modulated valve 318 may be used to control refrigerant flow to the orifice 316 from the liquid line 302. The modulation valve 318 allows flow control from a full open position to a full closed position. So it could be at full open to reduce liquid refrigerant accumulation and to lower the pressure quickly in the system. The controller 314 is communicatively coupled to the modulation valve 318. When the HVAC system is off, the modulated valve 318 may be set at a minimum non-zero position (e.g., 5-25% open) in order to equalize the pressure in the system. When the system restarts, the minimum non-zero position of the modulated valve 318 helps lower the discharge pressure during system re-startup due to system pressure equalization.

Again, the modulated valve 318 may be modulated to the minimum position to allow some amount of refrigerant pass through to equalize high side pressure and low side pressure when the HVAC system is not running. The minimum position could be different for different tonnage units. For example, without limitation, for light commercial rooftop units, the minimum position could be small (for example, up to 15%). As another non-limiting example, for larger commercial rooftop units, the minimum position could be big (for example, up to 25%). The flexibility of the modulation valve 318 could provide a benefit for different capacity level units for system pressure equalization if the system is shut off. When the compressor starts in a short time period (e.g., in 3-5 min), the minimum valve opening of the modulation valve 318 may help reduce unit cycling. Since the system pressure is equalized by the modulating valve 318 at the minimum position, when the compressor (e.g., 218) restarts in a short time period (e.g., in 3-5 min depending on different manufacture control strategy to protect compressor or if required by compressor manufacture for reliability purpose), the compressor may avoid starting at a higher discharge pressure level during startup period; otherwise, it could easily cause high pressure trip. Therefore, by avoiding the trips, the unit short cycles can be reduced.

The partial load pathway 310 includes a variable expansion device 320, e.g., a thermal expansion valve or TXV, sized and configured for partial load. The variable expansion device 320 may include a valve actuator 322 that includes a chamber 324 having a diaphragm coupled to the pin. A pressure equalizer port 326 is fluidly coupled to the suction line (see, e.g., 220 in FIG. 2) of the closed-conduit refrigeration circuit and allows a pressure input into the expansion valve or device 320. In such embodiments, the pressure equalization port 326 enables the expansion valve 320 to have input for pressure on the suction line. The variable expansion device 320, which again is sized for partial load conditions instead of design rating condition, is used for partial load operating conditions to reduce hunting (oscillations) and enhance the system performance.

The flow selector 306 may take numerous forms provided that it allows for selective control of the flow pathway between two or more paths. In the embodiment of FIG. 3, the flow selector 306 provides control between the full-load pathway 308 and the partial-load pathway 310. While only two pathways are shown, it should be understood that in other embodiments, there could be a plurality of partial-load pathways with variable valves on each sized for different load conditions and with the flow selector 306 configured to selectively direct flow to the different pathways (full-load and the plurality of partial-load pathways) based on a control signal from the controller 314. Again, the flow selector 306 may take numerous forms, but in one embodiment, the flow selector 306 comprises a three-way valve 400 as shown in FIGS. 4A-4B.

Figure 4A:
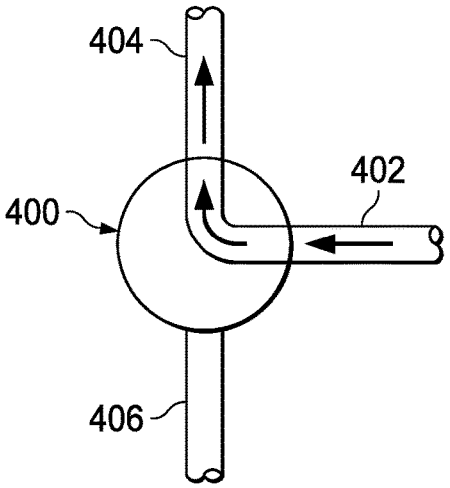
FIG. 4A is schematic diagram of an illustrative embodiment of a flow selector suitable for use in the HVAC systems, such as in FIGS. 1 and 2, and shown in a first position.
Figure 4B:
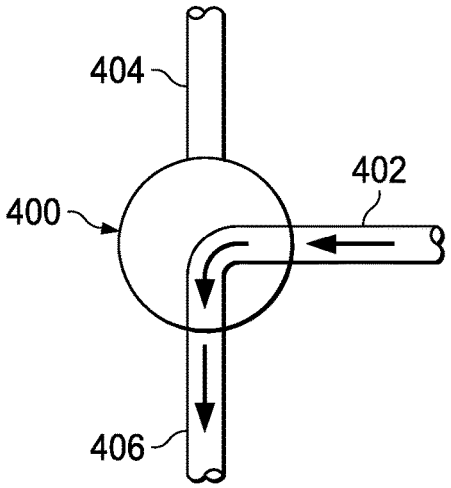
FIG. 4B is schematic diagram of the flow selector of FIG. 4A shown in a second position.

Referring now primarily to FIGS. 4A and 4B, the flow selector 306 (FIG. 3) may be a three-way valve 400 as shown. In FIGS. 4A and 4B, the three-way valve 400 receives a liquid line 402 (see also, e.g., 302 in FIG. 3) and discharges to either a full-load pathway 404 or at least one partial-load pathway 406. FIG. 4A shows the discharge to the full-load pathway 404. FIG. 4B shows the discharge to at least one partial-load pathway 406. Other flow selectors may used such as four-way valve or reversing valve.

Figure 5:
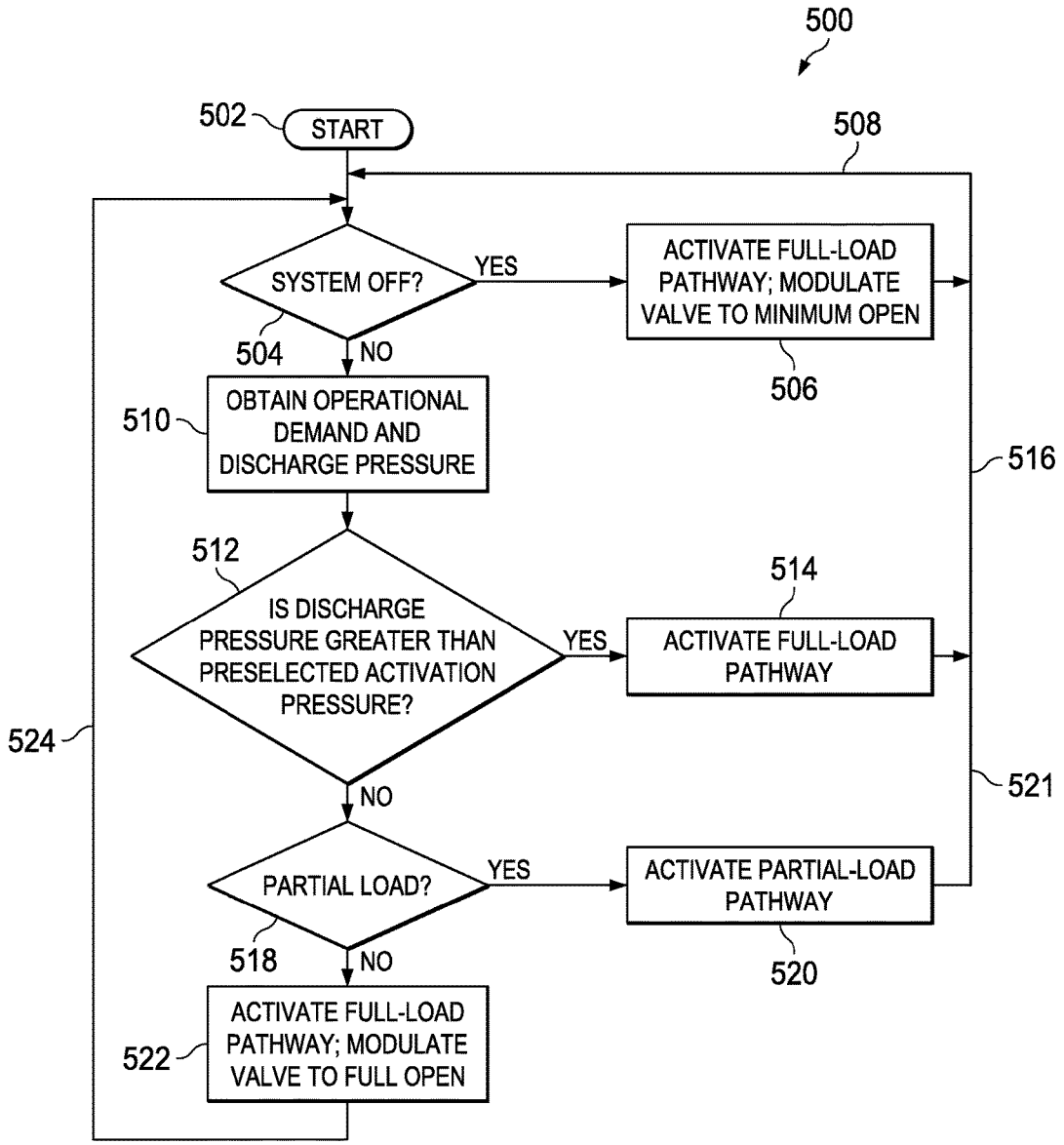
FIG. 5 is an illustrative, non-limiting process flow diagram of an illustrative example of a process to be carried out with a controller.

Referring now primarily to FIG. 5 and to a lesser extent to FIGS. 2 and 3, a method 500 for cooling air in a heating, ventilating, and air conditioning (HVAC) system is presented. At step 502, the process begins. Then at interrogatory 504 the question is asked whether the system 200 is off, or not powered? If it is off, then the process flow goes to step 506. While not explicitly shown, between 504 and 506 in some embodiments, the process may also consider if the compressor is off, and if off, the process would again continue to step 506. In any event, at step 506, the full-load pathway 308, which includes the fixed orifice, is selected and the modulation valve 318 is set the minimum open position as previously discussed.

If the answer to interrogatory 504 is negative, i.e., the unit or system is on, the process goes to step 510. At step 510, the controller obtains the system demand and discharge pressure; that is, obtains the operational demand status, and the discharge pressure taken by at least one pressure transducer, e.g., pressure transducer 219. Then interrogatory 512 asks whether the discharge pressure is greater than a preselected or pre-defined activation pressure? If affirmative, the process goes to step 514 where the controller (211, 314) causes the flow selector 203 to select the full-load pathway 205 such that the fixed orifice is active and the modulating valve is full open. If interrogatory 512 is negative, the process proceeds to interrogatory 518 that asks if the system is in a partial load demand? If it is, the process goes to step 520 where the controller causes the flow selector 203 to select the partial-load pathway 207, which utilizes the TXV. If interrogatory 518 is negative, the process goes to step 522 where again the full-load pathway 205 is activated by the controller using the flow selector 203 and the modulation valve 223, 318 is set to full open. The processor continues to monitor and operate by returning along path 524 to interrogatory 504. This is just one illustrative, non-limiting embodiment of the process flow.

A potential advantage of the HVAC systems herein may be that the systems can operate with less frequent interruptions from high-pressure trips. Again this is because the orifice 316 is sized based on a rating condition to meet the performance requirement. With the orifice 316, the head pressure can be managed due to less refrigerant accumulation in the micro-channel coil at high pressure.

Another advantage may be that the systems herein provide better cooling to occupied spaces instead of partial cooling or even no cooling since there is no need to unload the compressor or reduce compressor speed or shutdown to avoid the high pressure trips. Cooling capacity will not be compromised, and the system will meet customer requirements for cooling especially during very hot conditions (high ambient condition). In contrast, to reduce high pressure trips in some systems, some control logic could unload the compressor to a certain level or reduce compressor speed for lower head pressure or shut off unit because of many high pressure trips, which can only provide partial cooling (for example 60% cooling capacity) or even no cooling (for example, unit shut off because of many trips).

Another advantage may be that the HVAC systems herein may improve reliability of the systems or reduce compressor failures by eliminating short cycles. In addition, the oil management for the compressor may be improved. Short cycles may increase the chances that the compressor will fail because the compressor oil may be trapped in the system when the compressor is in the off cycle when the system operation period is short. An amount of oil is pumped from the compressor crankcase when compressor starts, and with repeating short cycles, oil can be lost from the crankcase. As a result, the compressor could run without proper lubrication to the bearings and therefore the probability of damage rises.

Short cycles can make system operation unstable due to delayed expansion device response at sudden system operating condition changes, and cause possible refrigerant flooding that also can damage the compressor. If the short cycles can be eliminated, system operating reliability and compressor failure can be improved The systems may be used with commercial micro-channel condensers on roof top units. The systems may be used with fixed-speed compressors, two capacity compressors, variable speed compressors, tandem compressors, one circuit or multiple circuits, etc.

It should be understood that numerous embodiments and illustrations are possible. Some additional illustrative embodiments or examples include the following.

EXAMPLE 1

According to an illustrative embodiment, a heating, ventilating, and air conditioning (HVAC) system includes a closed refrigeration circuit; a compressor fluidly coupled to the closed refrigeration circuit; a condenser fluidly coupled to the closed refrigeration circuit downstream of the compressor; an evaporator fluidly coupled to the closed refrigeration circuit; and an expansion device subsystem fluidly coupled to the closed refrigeration circuit and positioned between the condenser and the evaporator. A portion of the closed refrigeration circuit between the compressor and expansion device subsystem includes a high-pressure side conduit. The system further includes at least one pressure transducer coupled to the high-pressure side conduit for measuring a pressure therein and a controller communicatively coupled to the at least one pressure transducer. The expansion device subsystem includes a flow selector operative to receive a refrigerant from the high-pressure side conduit and selectively deliver the same to a full-load pathway or to a partial-load pathway; an actuator coupled to the flow selector for selectively moving the flow selector between the full-load pathway and the partial-load pathway. The actuator is communicatively coupled to the controller for receiving a control signal therefrom. The full-load pathway includes an orifice for stepping down pressure, and the orifice is sized and configured for a full load application or condition. The partial load pathway includes a variable expansion device sized and configured for partial load application or condition. The controller includes a memory and a processor. The controller is configured to: activate the actuator to move the flow selector to the full-load pathway when pressure as measured by the at least one pressure transducer indicates pressure is greater than a first preselected activation pressure or when operational demand for the compressor is at full load, and activate the actuator to move the flow selector to the partial-load pathway when pressure as measured by the at least one pressure transducer indicates pressure is less than a second preselected activation pressure and when operating demand is at partial load.

EXAMPLE 2

The system of Example 1, wherein the full-load pathway includes a modulating valve upstream of the orifice.

EXAMPLE 3

The system of Example 1 or 2, wherein the condenser includes a micro-channel condenser.

EXAMPLE 4

The system of any of Examples 1-3, wherein the controller is further configured to activate the actuator to move the flow selector to the full-load pathway when the system is not powered or the compressor is shutoff.

EXAMPLE 5

The system of Example 1, wherein the full-load pathway includes a modulating valve upstream of the orifice and coupled to the controller, and wherein the controller is further configured to activate the actuator to move the flow selector to the full-load pathway when the system is not powered or the compressor is shutoff and to set the modulating valve to a bleed position between 5 and 25 percent open or a setting adequate to bleed pressure and help with startup.

EXAMPLE 6

The system of any of Examples 1-5, further including a sensory bulb thermally coupled to the closed refrigeration circuit between the evaporator and compressor, and wherein the bulb is fluidly coupled to a sensing conduit at one end of the sensing conduit, the sensing conduit and bulb having a working fluid, and wherein a second end of the sensing conduit if fluidly coupled to a portion of the variable expansion device of the partial-load pathway.

EXAMPLE 7

The system of any of Examples 1-6, wherein the at least one pressure transducer is positioned between the condenser and the compressor and proximate to the compressor.

EXAMPLE 8

The system of any of Examples 1-7, wherein the first preselected activation pressure is the same as the second preselected activation pressure.

EXAMPLE 9

The system of any of Examples 1-8, wherein the flow selector includes a three-way valve and the actuator includes a solenoid associated with the three-way valve.

EXAMPLE 10

The system of any of Examples 1-9, wherein the flow selector includes a four-way valve or a reversing valve.

EXAMPLE 11

The system of Example 1, wherein the condenser includes a micro-channel condenser, wherein the full-load pathway includes a modulating valve upstream of the orifice and coupled to the controller, and wherein the controller is further configured to activate the actuator to move the flow selector to the full-load pathway when the system is not powered or the compressor is shutoff and to set the modulating valve to a bleed position between 5 and 25 percent open, further including a sensory bulb thermally coupled to the closed refrigeration circuit between the evaporator and compressor, and wherein the bulb is fluidly coupled to a sensing conduit at one end of the sensing conduit, the sensing conduit and bulb having a working fluid, and wherein a second end of the sensing conduit if fluidly coupled to a portion of the variable expansion device of the partial-load pathway.

EXAMPLE 12

According to an illustrative embodiment, a method for cooling air in a heating, ventilating, and air conditioning (HVAC) system includes moving refrigerant through a closed refrigeration circuit having a compressor, a condenser, an expansion device subsystem, and an evaporator. The expansion device subsystem includes a full-load pathway and at least one partial-load pathway and a flow selector for directing refrigerant flow from the condenser to either the partial-load pathway or the full-load pathway. The method further includes measuring a refrigerant pressure on a high-pressure side of the closed refrigeration circuit; directing refrigerant flow from the condenser to the full-load pathway when the refrigerant pressure is greater than or equal to a first preselected activation pressure and stepping down a refrigerant pressure with a set orifice; directing refrigerant flow from the condenser to the partial-load pathway when operational demand is at partial load and when the refrigerant pressure is less than or equal to a second preselected activation pressure and stepping down a refrigerant pressure with a variable expansion device configured for partial loads; and delivering refrigerant from the full-load pathway or partial-load pathway to the evaporator.

EXAMPLE 13

The method of Example 12, wherein the condenser includes a micro-channel condenser.

EXAMPLE 14

The method of any of Examples 12 or 13, further including thermally coupling a portion of the variable expansion device associated with the partial-load pathway to a portion of the closed refrigeration circuit between the evaporator and the compressor.

EXAMPLE 15

The method of any of Examples 12-14, further including configuring the expansion device subsystem to receive refrigerant through the full-load pathway when the compressor is turned off.

EXAMPLE 16

The method of any of Examples 12-15, wherein the full-load pathway further includes a modulated valve and wherein the method further includes moving the flow selector to direct flow to the full-load pathway and opening the modulated valve to between 5 and 25 percent open when the system is not powered or the compressor is turned off.

EXAMPLE 17

The method of any of Examples 12-16, further including configuring the expansion device subsystem to receive refrigerant through the partial-load pathway when the operational demand is partial load and when a refrigerant discharge pressure on a discharge line of the closed refrigeration circuit is less than the second preselected activation pressure.

EXAMPLE 18

According to an illustrative, non-limiting embodiment, a heating, ventilating, and air conditioning (HVAC) system includes a closed refrigeration circuit including a compressor fluidly coupled to a condenser fluidly coupled to a multi-path expansion device subsystem fluidly coupled to an evaporator. The multi-path expansion device subsystem includes a full-load pathway having a set orifice for stepping down pressure and sized for full load application, a partial-load pathway having a thermal expansion valve sized for partial load application, and a variable-path valve for selectively directing flow between at least the full-load pathway and the partial-load pathway. The system further includes at least one pressure transducer for measuring a high side pressure of the closed refrigeration circuit; and a controller communicatively coupled to the at least one pressure transducer and with an actuator associated with the variable-path valve for selecting between the full-load pathway and the partial-load pathway. The full-load pathway is automatically selected when high side pressure exceeds a first preselected pressure or when the system is off and wherein the partial-load pathway is automatically selected when the demands is at partial load requirements and when the high side pressure is below a second preselected pressure.

In the detailed description of the preferred embodiments herein, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the claims.

Unless otherwise indicated, as used throughout this document, "or" does not require mutual exclusivity.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. A heating, ventilating, and air conditioning (HVAC) system comprising:

a closed refrigeration circuit;

a compressor fluidly coupled to the closed refrigeration circuit;

a condenser fluidly coupled to the closed refrigeration circuit downstream of the compressor, wherein the condenser comprises a micro-channel condenser;

an evaporator fluidly coupled to the closed refrigeration circuit;

an expansion device subsystem fluidly coupled to the closed refrigeration circuit and positioned between the condenser and the evaporator;

wherein a portion of the closed refrigeration circuit between the compressor and expansion device subsystem comprises a high-pressure side conduit;

at least one pressure transducer coupled to the high-pressure side conduit for measuring a pressure therein;

a controller communicatively coupled to the at least one pressure transducer;

wherein the expansion device subsystem comprises:

a flow selector operative to receive a refrigerant from the high-pressure side conduit and selectively deliver the same to a full-load pathway or to a partial-load pathway, an actuator coupled to the flow selector for selectively moving the flow selector between the full-load pathway and the partial-load pathway, wherein the actuator is communicatively coupled to the controller for receiving a control signal therefrom, wherein the full-load pathway comprises a first expansion device that comprises an orifice for stepping down pressure, wherein the orifice is sized and configured for a full load application, and wherein the partial load pathway comprises a second expansion device that comprises a variable expansion device sized and configured for partial load;

wherein the controller comprises memory and a processor, and wherein the controller is configured to:

activate the actuator to move the flow selector to the full-load pathway when a pressure as measured by the at least one pressure transducer indicates the pressure is greater than a first preselected activation pressure or when operational demand is at full load, and activate the actuator to move the flow selector to the partial-load pathway when the pressure as measured by the at least one pressure transducer indicates that the pressure is less than a second preselected activation pressure and when operational demand is at partial load.

2. The system of claim 1, wherein the full-load pathway comprises a modulating valve upstream of the orifice.

3. The system of claim 1, wherein the controller is further configured to activate the actuator to move the flow selector to the full-load pathway when the system is not powered or when the compressor is shut off.

4. The system of claim 1, wherein the full-load pathway comprises a modulating valve upstream of the orifice and coupled to the controller, and wherein the controller is further configured to activate the actuator to move the flow selector to the full-load pathway when the system is not powered or when the compressor is shut off and to set the modulating valve to a bleed position.

5. The system of claim 1, further comprising a sensory bulb thermally coupled to the closed refrigeration circuit between the evaporator and compressor, and wherein the sensory bulb is fluidly coupled to a sensing conduit at one end of the sensing conduit, the sensing conduit and the sensory bulb having a working fluid, and wherein a second end of the sensing conduit is fluidly coupled to a portion of the variable expansion device of the partial-load pathway.

6. The system of claim 1, wherein the at least one pressure transducer is positioned between the condenser and the compressor.

7. The system of claim 1, wherein the first preselected activation pressure is the same as the second preselected activation pressure.

8. The system of claim 1, wherein the flow selector comprises a three-way valve and the actuator comprises a solenoid associated with the three-way valve.

9. The system of claim 1, wherein the flow selector comprises a reversing valve.

10. The system of claim 1, wherein the full-load pathway comprises a modulating valve upstream of the orifice and coupled to the controller, and wherein the controller is further configured to activate the actuator to move the flow selector to the full-load pathway when the system is not powered or the compressor is shut off and to set the modulating valve to a bleed position between 5 and 25 percent open, further comprising a sensory bulb thermally coupled to the closed refrigeration circuit between the evaporator and compressor, and wherein the sensory bulb is fluidly coupled to a sensing conduit at one end of the sensing conduit, the sensing conduit and the sensory bulb having a working fluid, and wherein a second end of the sensing conduit is fluidly coupled to a portion of the variable expansion device of the partial-load pathway.

11. A heating, ventilating, and air conditioning (HVAC) system comprising:

a closed refrigeration circuit comprising a compressor fluidly coupled to a condenser fluidly coupled to a multi-path expansion device subsystem fluidly coupled to an evaporator, wherein the condenser comprises a micro-channel condenser;

wherein the multi-path expansion device subsystem comprises:

a full-load pathway having a first expansion device disposed within the pathway that comprises a set orifice for stepping down pressure and sized for full load application, a partial-load pathway having a second expansion device that comprises a thermal expansion valve sized for partial load application, and a variable-path valve for selectively directing flow between at least the full-load pathway and the partial-load pathway;

at least one pressure transducer for measuring a high side pressure of the closed refrigeration circuit; and a controller communicatively coupled to the at least one pressure transducer on a discharge line and with an actuator associated with the variable-path valve for selecting between the full-load pathway and the partial-load pathway.

* * * * *